US005138237A

United States Patent [19]

Kane et al.

[11] Patent Number: 5,138,237

[45] Date of Patent: Aug. 11, 1992

[54] FIELD EMISSION ELECTRON DEVICE EMPLOYING A MODULATABLE DIAMOND SEMICONDUCTOR EMITTER

[75] Inventors: Robert C. Kane, Woodstock, Ill.; James E. Jaskie, Scottsdale, Ariz.

[73] Assignee: Motorola, Inc., Schaumburg, Ill.

[21] Appl. No.: 747,564

[22] Filed: Aug. 20, 1991

[51] Int. Cl.[5] ..... H01J 17/12; H01J 1/46

[52] U.S. Cl. ..... 315/349; 313/308; 313/311

[58] Field of Search ..... 315/326, 169.1, 169.4, 315/349, 308, 311, 309, 336, 310, 107.5

[56] References Cited

U.S. PATENT DOCUMENTS

| | | | |
|---|---|---|---|
| 3,921,022 | 11/1975 | Levine | 313/309 |
| 3,970,887 | 7/1976 | Smith et al. | 313/336 X |
| 3,998,678 | 12/1976 | Fukase et al. | 445/24 X |
| 4,008,412 | 2/1977 | Yuito et al. | 313/309 |
| 4,084,942 | 4/1978 | Villalobos | 313/311 X |
| 4,095,133 | 6/1978 | Hoeberechts | 313/336 |
| 4,513,308 | 4/1985 | Greene et al. | 313/310 X |
| 4,780,684 | 10/1988 | Kosmahl | 330/54 |
| 4,990,766 | 2/1991 | Simms et al. | 250/213 VT |
| 5,053,673 | 10/1991 | Tomii et al. | 313/308 |
| 5,064,396 | 11/1991 | Spindt | 313/309 X |

FOREIGN PATENT DOCUMENTS

| | | | |
|---|---|---|---|
| 0296532 | 11/1989 | Japan | 313/311 |
| 0060024 | 2/1990 | Japan | 313/311 |

*Primary Examiner*—Eugene R. LaRoche
*Assistant Examiner*—Son Dinh
*Attorney, Agent, or Firm*—Eugene A. Parsons

[57] ABSTRACT

A field emission device having a diamond semiconductor electron emitter with an exposed surface exhibiting a low/negative electron affinity which is operably controlled by modulation of a junction depletion region. Application of a suitable operating voltage to a device gate electrode modulates the depletion width to control availability of electrons transiting the bulk of the electron emitter for emission at the exposed surface.

50 Claims, 5 Drawing Sheets

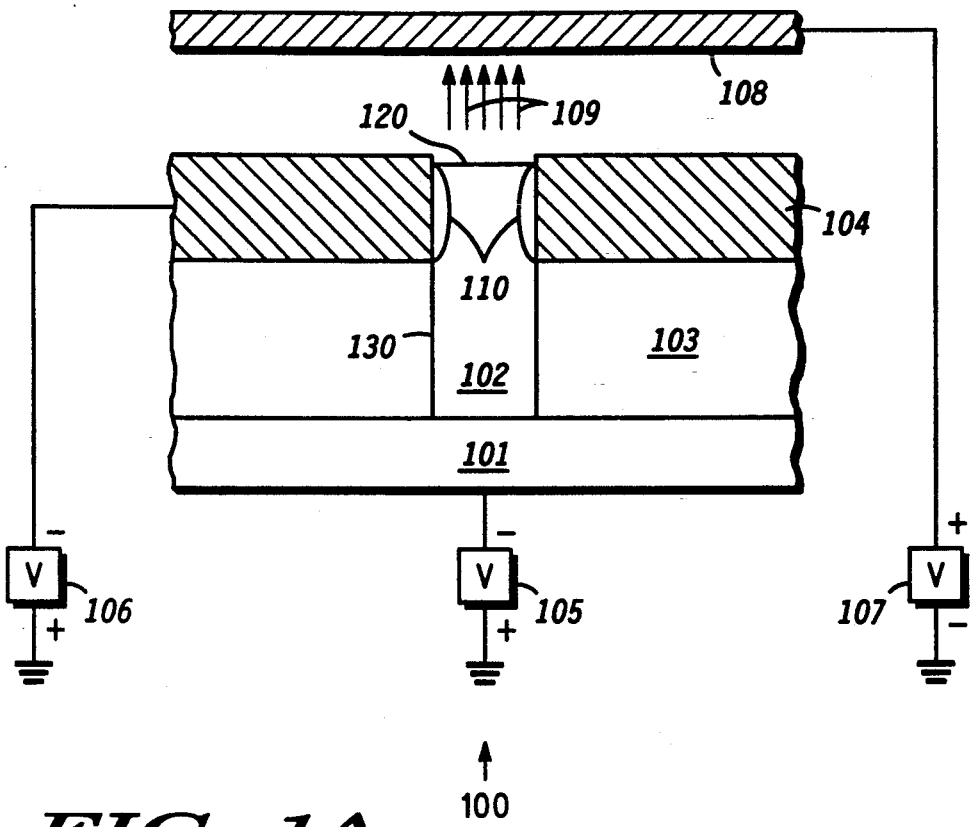
FIG. 1A
FIG. 1B
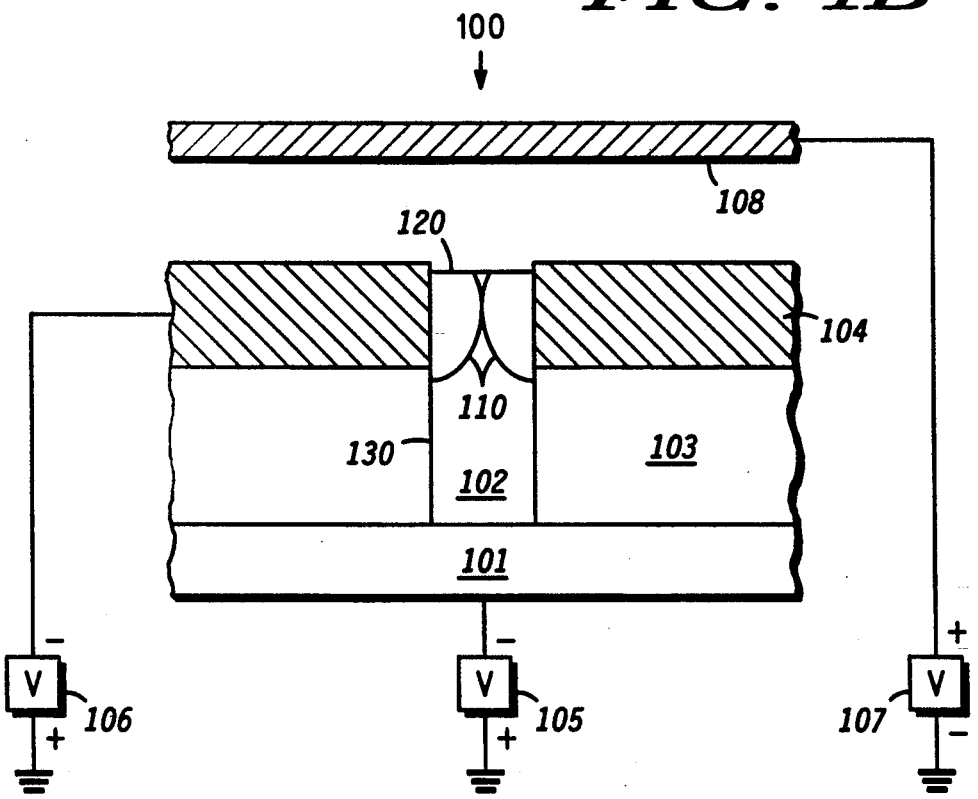

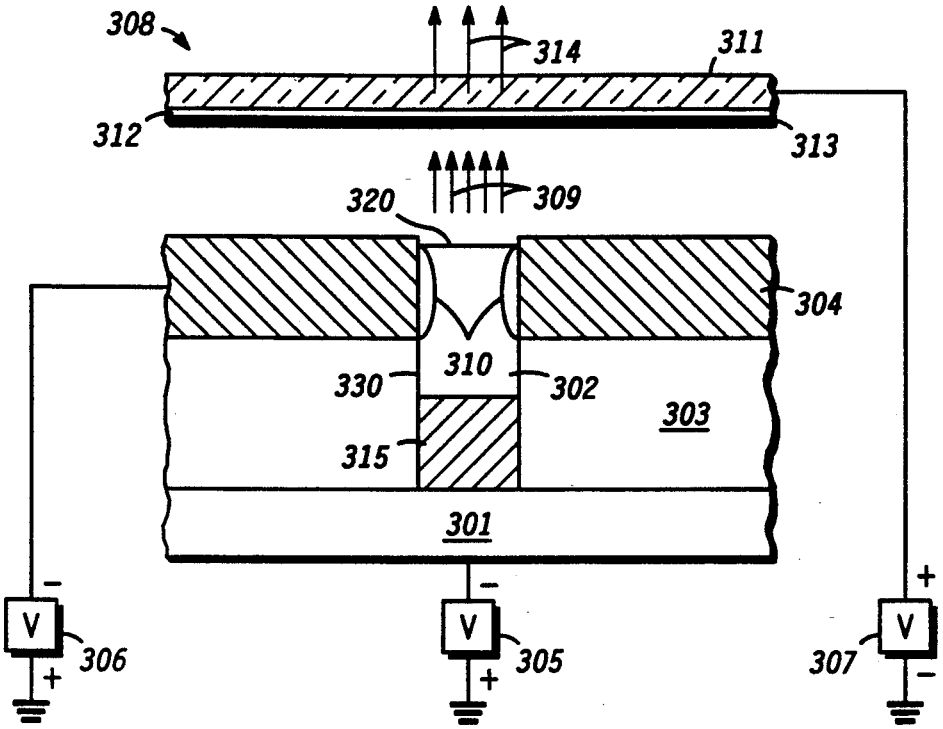
FIG. 3A
300
FIG. 3B
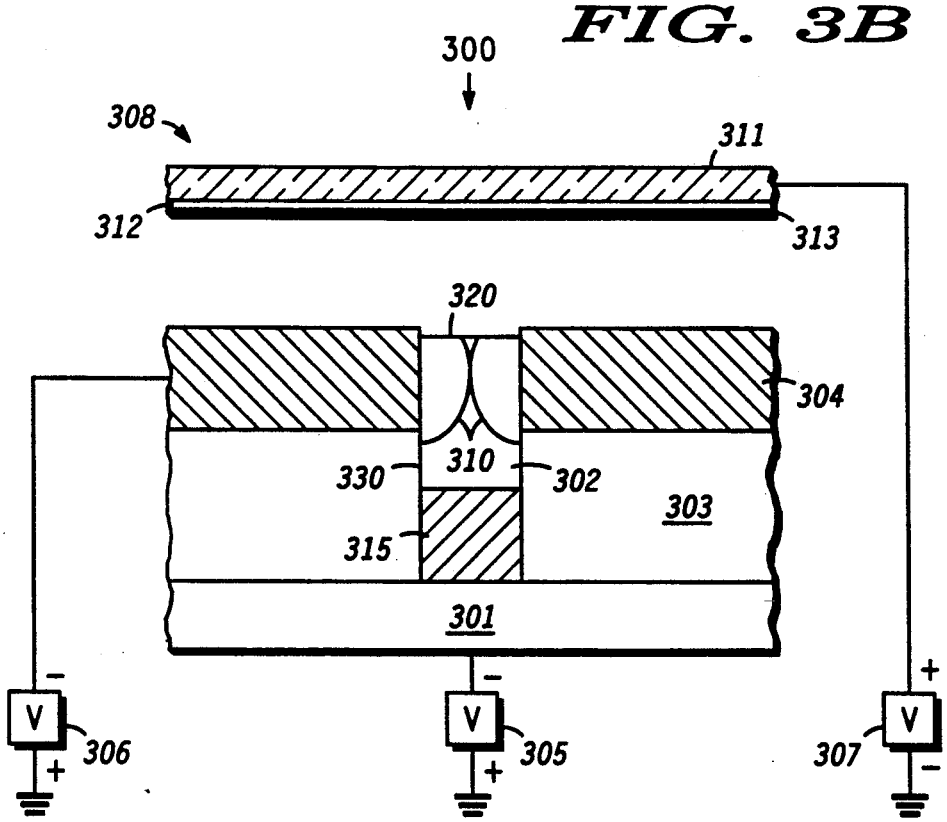

FIELD EMISSION ELECTRON DEVICE EMPLOYING A MODULATABLE DIAMOND SEMICONDUCTOR EMITTER

FIELD OF THE INVENTION

The present invention relates generally to field emission electron devices and more particularly to a field emission electron device employing an electron emitter with an emitting surface exhibiting low/negative electron affinity.

BACKGROUND OF THE INVENTION

Field emission devices and field emission electron emitters are known in the art. Typically, these prior art structures employ preferentially shaped electron emitters wherein an emitting tip/edge having a geometric discontinuity of small radius of curvature is formed. The desire for such a tip/edge feature is obviated by the need to provide for very strong electric field enhancement near the region of the electron emitter so that electrons may be extracted. In an attempt to increase the susceptibility to emit electrons techniques have been employed to provide work-function lowering materials, such as cesium, onto the surface of/directly into the bulk of electron emitters.

The need for emitting tips/edges with small radius of curvature imposes a restriction on repeatable realization of electron emitters. The technique of applying special materials to the surface of/in the bulk of emitters introduces operational instabilities due to the difficulty in maintaining the materials at/in the electron emitter.

Electron emitters of the prior art and field emission devices employing electron emitters of the prior art also suffer from damage incurred as a result of ion bombardment at the electron emitter. In the presence of very low residual gas pressures the emitters are still subjected to occasional ion attack which may damage the emitting tip/edge and render it useless.

Some other prior art field emission electron emitters do not employ tips/edges of small radius of curvature. However, such structures exhibit electron emission characteristics which impose significant limitations on emitter utility such as, for example, effectively controlling the emission current and emission trajectory.

Accordingly, there exists a need for a field emission device and a field emission electron emitter which overcomes at least some of the shortcomings of the prior art.

SUMMARY OF THE INVENTION

This need and others are substantially met through provision of an electrically modulatable electron emitter including a diamond semiconductor electron emitter having an emitting surface for emitting electrons and a major surface, and a layer of conductive/semiconductive material disposed at least partially on the major surface of the diamond semiconductor electron emitter.

This need and others are further met through a method of producing an electrically modulatable electron emitter including the steps of forming a diamond semiconductor electron emitter with an emitting surface for emitting electrons and a major surface, and forming a layer of conductive/semiconductive material in contact with the major surface of the diamond semiconductor electron emitter such that an electron depletion region, and a depletion region width associated therewith, is formed at an interface between the diamond semiconductor electron emitter and the layer of conductive/semiconductive material.

This need and others are still further met through provision of a field emission device including a supporting substrate having a major surface, a first layer of selectively patterned conductive/semiconductive material disposed on the major surface of the supporting substrate, a first selectively shaped diamond semiconductor electron emitter having a major surface and at least an emitting surface, the diamond shaped semiconductor electron emitter being disposed on the first layer of selectively patterned conductive/semiconductive material, a layer of insulator material disposed on the major surface of the supporting substrate and a part of the major surface of the diamond semiconductor electron emitter, a second layer of conductive/semiconductive material disposed on the layer of insulator material and in physical contact with the major surface of the diamond semiconductor electron emitter such that a junction having a depletion region, and a depletion region width associated therewith, is formed at the interface corresponding thereto, and an anode distally disposed with respect to the emitting surface of the diamond semiconductor electron emitter for collecting emitted electrons.

BRIEF DESCRIPTION OF THE DRAWINGS

FIG. 1A is a side elevational depiction of an embodiment of a field emission device in accordance with the present invention.

FIG. 1B is a second depiction of the embodiment described in FIG. 1A.

FIG. 3A is a side elevational depiction of another embodiment of a field emission device in accordance with the present invention.

FIG. 3B is a second depiction of the embodiment described in FIG. 3A.

DETAILED DESCRIPTION OF THE PREFERRED EMBODIMENTS

Figure 2:
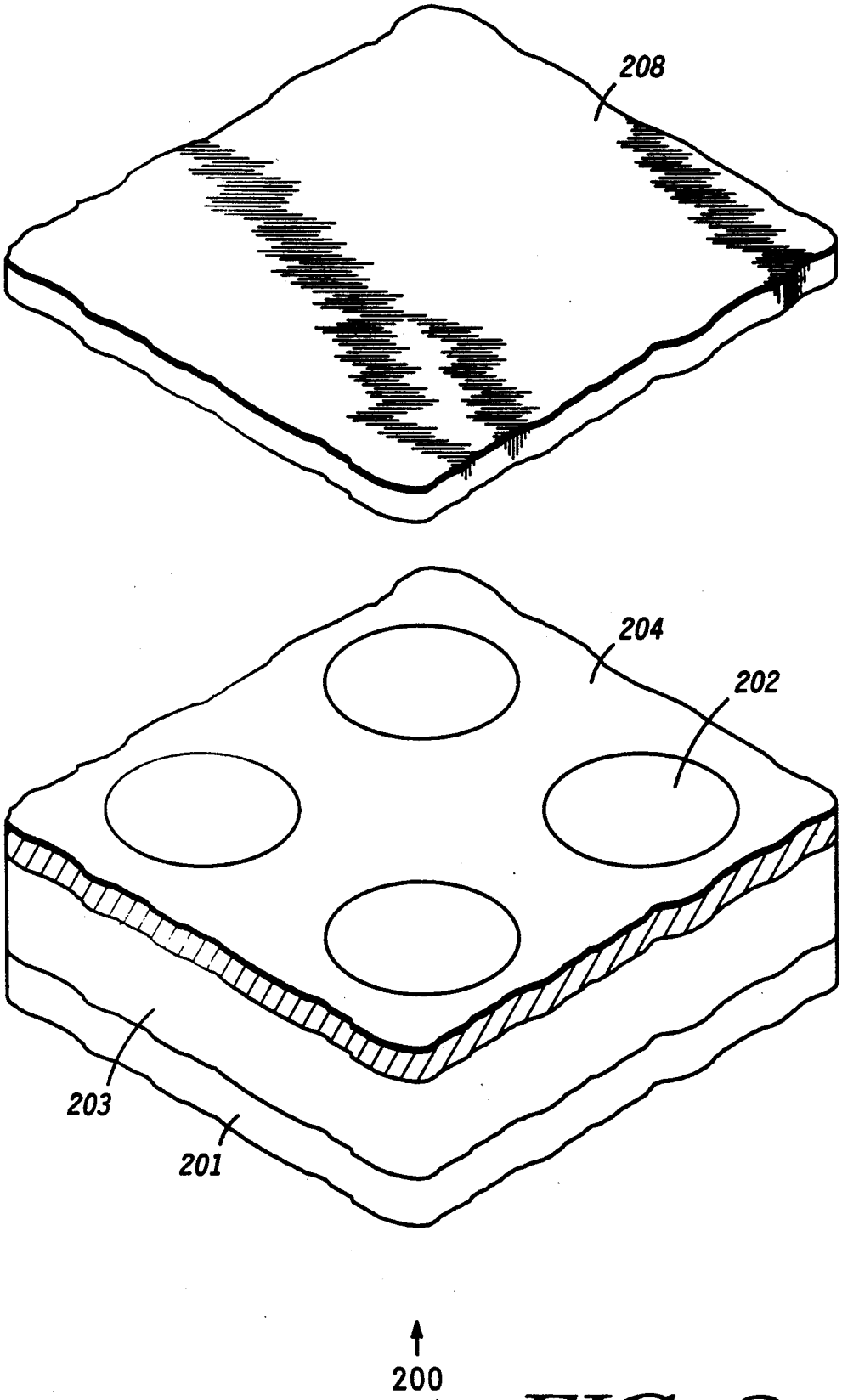
FIG. 2 is a partial perspective view of a field emission device in accordance with the present invention.

Referring now to FIG. 1A there is depicted a side elevational cross-sectional view of an embodiment of a field emission device 100 in accordance with the present invention. A supporting substrate 101 having a major surface is provided. A selectively shaped diamond semiconductor electron emitter 102 having a major surface 130 and an emitting surface 120, for emitting electrons, is disposed on the major surface of supporting substrate 101. Electron emitter 102 is selectively shaped, in a first method of realizing the diamond emitters, by initially growing a layer of diamond directly onto the major surface of supporting substrate 101 and subsequently selectively etching some of the diamond layer to selectively shape diamond semiconductor electron emitter 102. A layer 103 of insulator material is deposited on exposed parts of the major surface of supporting substrate 101 and disposed on major surface 130 of diamond semiconductor electron emitter 102. A layer 104 of conductive/semiconductive material is deposited on layer 103 and disposed on at least a part of major surface 130 of diamond semiconductor electron emitter 102.

A junction having a depletion region 110, and a depletion region width associated therewith, is formed at the interface between diamond semiconductor electron emitter 102 and layer 104 disposed thereon. An anode 108 is distally disposed with respect to emitting surface 120 of diamond semiconductor electron emitter 102 to collect emitted electrons, depicted by arrows 109. While diamond semiconductor electron emitter 102, and device 100, is illustrated as being generally perpendicular to supporting substrate 101, it should be understood that field emission device 100 could alternatively be formed, generally as described herein, in a horizontal position on a nonconducting supporting substrate.

FIG. 1A further depicts a first externally provided voltage source 106 operably coupled to layer 104 of conductive/semiconductive material. Voltage source 106 provides a variable voltage to layer 104 which will cause the width of junction depletion region 110 to vary correspondingly. This modulation of the width of junction depletion region 110 results in modulation of the electrons made available at emitting surface 120 of diamond semiconductor electron emitter 102.

A second externally provided voltage source 107 is operably coupled to anode 108 so that emitted electrons 109 are collected at anode 108. Voltage source 107 further provides an accelerating electric field in the region between anode 108 and emitting surface 120 of diamond semiconductor electron emitter 102. This electric field is utilized to remove electrons residing at/near emitting surface 120 of diamond semiconductor electron emitter 102 and sweep them into the free-space region between anode 108 and emitting surface 120 of diamond semiconductor electron emitter 102. In the absence of any accelerating electric field, electrons will not transit the region between anode 108 and diamond semiconductor electron emitter 102.

A third externally provided voltage source 105 is operably coupled to supporting substrate 101. Alternatively, supporting substrate 101 may be operably coupled to a ground reference potential corresponding to 0.0 volts in place of voltage source 105.

FIG. 1B depicts structure 100 wherein electrons arrive at emitting surface 120 of diamond semiconductor electron emitter 102 by transmitting the bulk of the diamond semiconductor and are subsequently swept away from emitting surface 120 by any accelerating electric field. However, modulation of the width of junction depletion region 110 is shown to effectively control the availability of electrons at emitting surface 120. By so doing electron emission rates are effectively modulated. Increasing the magnitude of the voltage operably coupled to layer 104 results in an increase in the width of junction depletion region 110. Since junction depletion region 110 is substantially void of conduction band electrons and since electrons transiting the bulk of the diamond semiconductor do not traverse junction depletion region 110, it is possible to stop the flow of electrons to emitting surface 120 by applying a voltage of appropriate magnitude to layer 104, in which case field emission device 100 is effectively placed in the OFF mode and electron emission is cut-off. FIG. 1B depicts the width of junction depletion region 110 as being so extensive as to effectively traverse the entire width of diamond semiconductor electron emitter 102.

It is one object of the diamond semiconductor of the present invention to provide a field emission electron device which does not suffer from the breakdown mechanisms inherent in the structures of the prior art wherein very high electric fields must be generated at the electron emitter in order to induce electron emission. The diamond semiconductor material employed for the electron emitter in the present invention exhibits an electron affinity of less than 1.0 electron volts corresponding to one crystallographic plane and an electron affinity of less than 0.0 electron volts corresponding to yet another crystallographic plane. A desired electron affinity is attained by depositing the diamond semiconductor material with emitting surface 120 lying in the chosen crystallographic plane. As such, much smaller magnitude electric fields may be employed to achieve substantial electron emission than is the case with electron emitters of the prior art. Further, there is no need to provide geometric discontinuities of small radius of curvature as required in prior art embodiments.

FIG. 2 is a partial perspective view of an embodiment of a field emission device 200 in accordance with the present invention wherein features corresponding to those first described in FIGS. 1A & 1B are similarly referenced beginning with the numeral "2". Device 200 includes a plurality of diamond semiconductor electron emitters 202 disposed as an array of electron emitters within a single structure. Device operation is essentially similar to that described previously wherein electron emission is substantially controlled by providing a modulating voltage to a layer 204 of conductive/semiconductive material as described previously with reference to FIG. IB. Emitted electrons are collected by an anode 208.

FIG. 3A is a side elevational cross sectional depiction of another embodiment of a field emission device 300 employing a diamond semiconductor electron emitter 302 in accordance with the present invention and wherein features corresponding to features previously identified with reference to FIGS. 1A & 1B are similarly referenced beginning with the numeral "3". In device 300, diamond semiconductor electron emitter 302 is disposed on a first layer 315 of conductive/semiconductive material which is selectively patterned subsequent to deposition on the major surface of supporting substrate 301. Alternatively, the major surface of supporting substrate 301 may be selectively exposed by providing a patterned mask layer, and layer 315 of conductive/semiconductive material selectively deposited onto the selectively exposed part of the major surface of the supporting substrate. Both techniques are commonly employed in the known art. In this embodiment a second layer 304 of conductive/semiconductive material corresponds to and performs the same function as layer 104 of conductive/semiconductive material described previously with reference to FIG. 1A.

FIG. 3A further depicts an anode 308 comprising a plurality of layers including a substantially optically transparent faceplate 311 having a surface, a layer of cathodoluminescent material 312 disposed on the surface of faceplate 311, and a conductive layer 313 disposed on cathodoluminescent layer 312. Emitted electrons, depicted by arrows 309, traversing the region between emitting surface of diamond semiconductor electron emitter 302 and distally disposed anode 308 imparts energy to active sites within cathodoluminescent layer 312 to stimulate photon emission, depicted by arrows 314, which is observed through substantially optically transparent faceplate 311.

FIG. 3B is a side elevational cross-sectional depiction of device 300 functioning as described previously with reference to FIG. 1B. Voltage supplies 305, 306 and 307 are connected and operate as previously described. In device 300, electron emission from diamond semiconductor electron emitter 302 is effectively modulated by applying an appropriate externally provided voltage to layer 304 of conductive/semiconductive material to modulate the width of junction depletion region 310. Modulation of electron emission modulates photon emission from cathodoluminescent layer 312 to produce a visual display.

Figure 4:
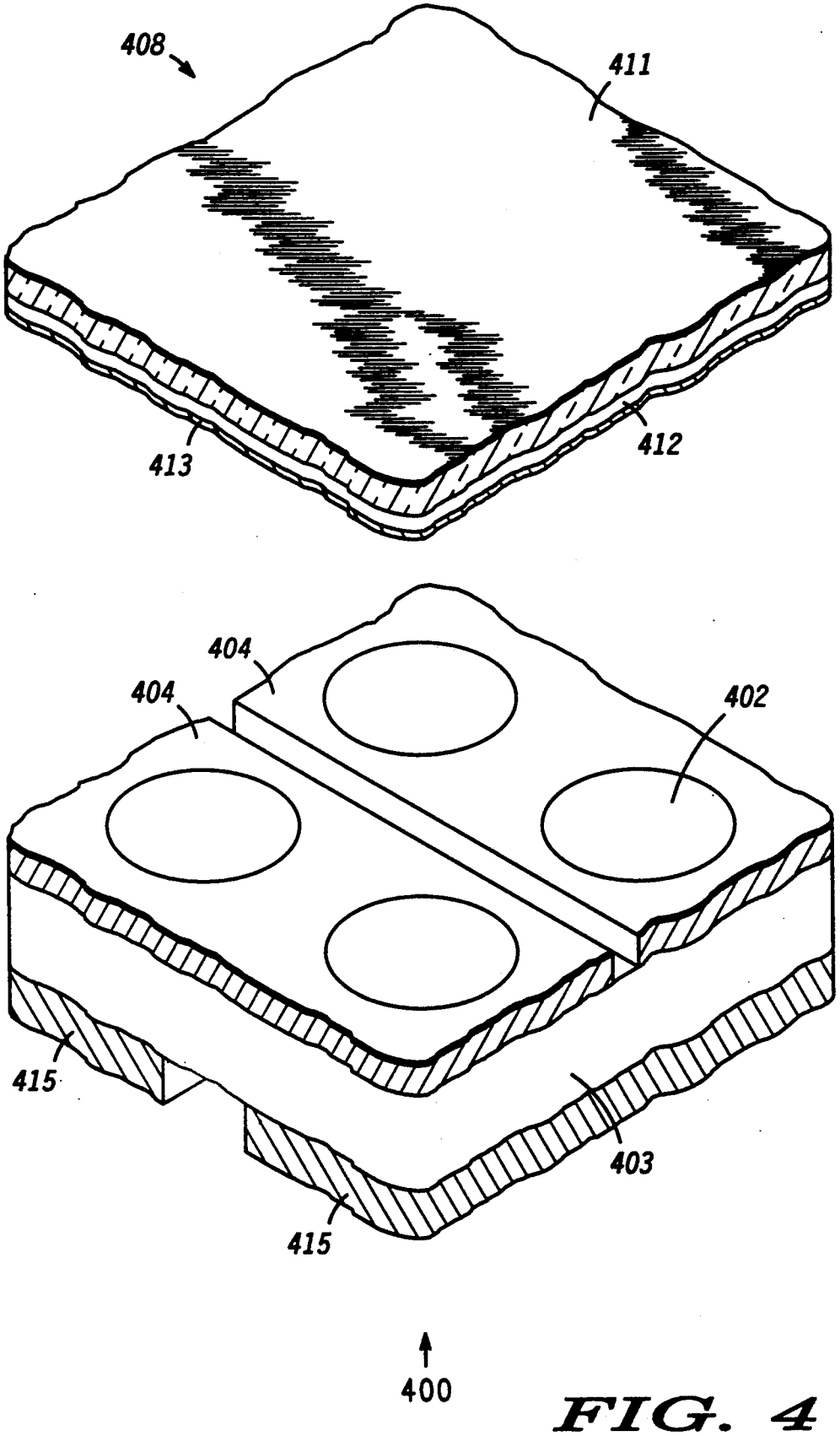
FIG. 4 is a partial perspective view of a field emission device in accordance with the present invention.

Referring now to FIG. 4 there is depicted a partial perspective view of a device 400 wherein features corresponding to features previously identified with reference to FIG. 3A & 3B are similarly referenced beginning with the numeral "4". In device 400, a selectively patterned first layer 415 of conductive/semiconductive material is realized as a plurality of electrically independent stripes. Similarly in device 400 a second layer 404 of conductive/semiconductive material is selectively patterned as a plurality of stripes. It should be understood that the term strips is herein defined to encompass any shapes utilized for specific applications, including but not limited to regions or areas, in which layers 415 and 404 are constructed with electrically separate portions. So formed, each of a plurality of diamond semiconductor electron emitters 402 are selectively placed in the ON/OFF mode and electron emission controlled through provision of selecting the voltage applied to each of the electrically independent stripes. By so doing selected regions of a cathodoluminescent layer 412 are induced to emit photons resulting in the formation of an image observable through a substantially optically transparent faceplate 411.

Figure 5:
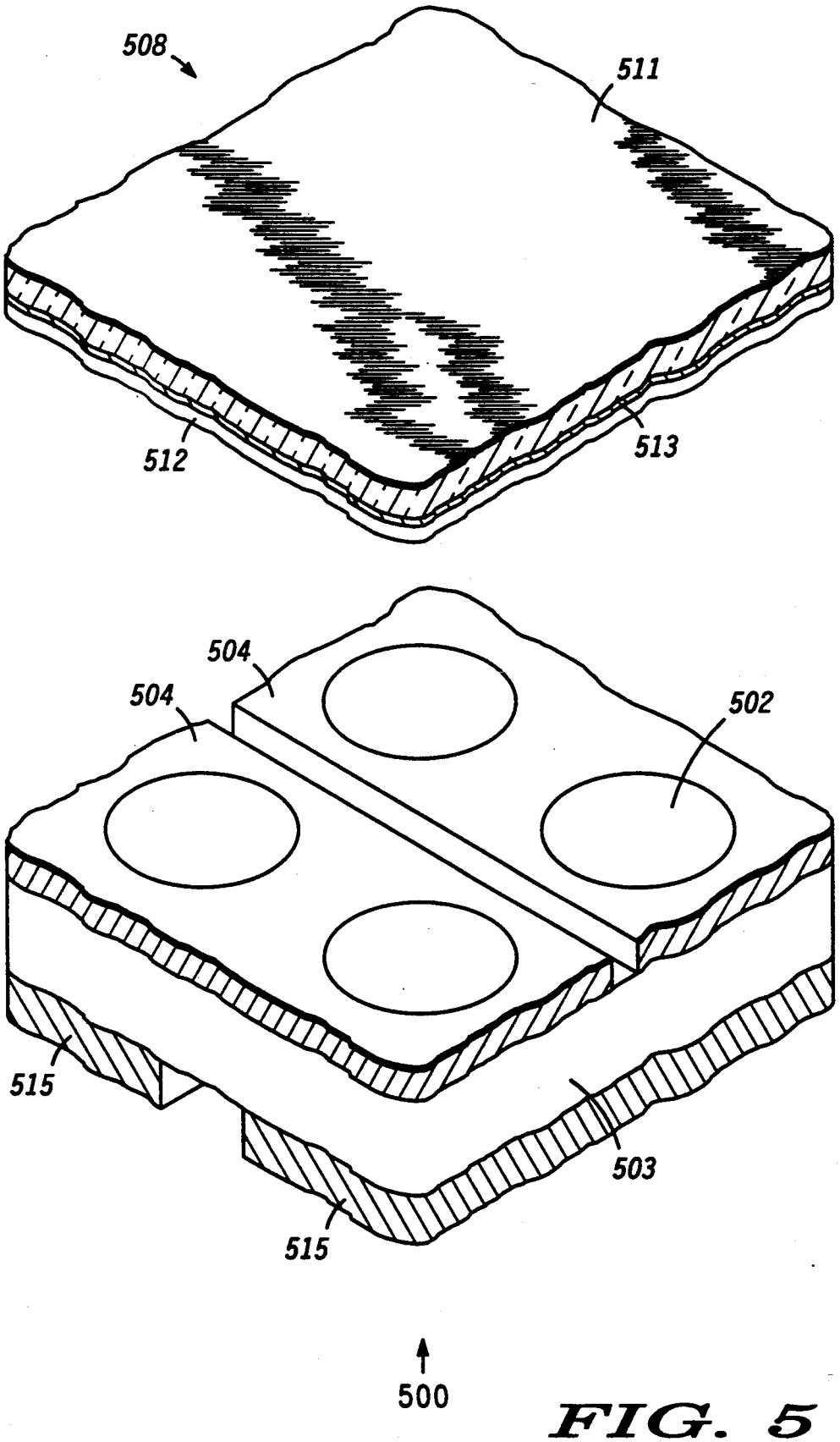
FIG. 5 is a partial perspective view of a modified field emission device similar to FIG. 4.

Referring now to FIG. 5 there is depicted a partial perspective view of a device 500 wherein features corresponding to features previously identified with reference to FIG. 4 are similarly referenced beginning with the numeral "5". Device 500, further depicts an anode 508 comprising a plurality of layers including a substantially optically transparent faceplate 511 having a surface, a conductive layer 513 disposed on the surface of faceplate 511, and a layer of cathodoluminescent material 512 disposed on conductive layer 513. It will of course be understood that in this specific embodiment conductive layer 513 is formed of substantially optically transparent material so that photons emitted by cathodoluminescent layer 512 are observable through faceplate 511 and conductive layer 513.

Thus, improved electron emitters are disclosed which include diamond semiconductor material for the electron emitter, which exhibits an electron affinity of less than 1.0 electron volts corresponding to one crystallographic plane and an electron affinity of less than 0.0 electron volts corresponding to yet another crystallographic plane. As such, much smaller magnitude electric fields may be employed to achieve substantial electron emission than is the case with electron emitters of the prior art. Because of this reduced electron affinity the electron emitters are not limited to geometric formations, such as tips/edges of small radius of curvature, that incur damage as a result of ion bombardment. Further, in the presence of very low residual gas pressures the emitters are not subjected to ion attack which damages the emitting tip/edge and renders it useless.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

What we claim is:

1. An electrically modulatable electron emitter comprising:

a diamond semiconductor electron emitter having an emitting surface for emitting electrons and a major surface; and a layer of conductive/semiconductive material disposed at least partially on the major surface of the diamond semiconductor electron emitter and forming a junction depletion region therewith.

2. The electron emitter of claim 1 wherein the diamond semiconductor electron emitter is disposed on a supporting substrate.

3. The electron emitter of claim 1 wherein at least a part of the emitting surface exhibits an electron affinity of less than 1 electron volt.

4. The electron emitter of claim 1 wherein at least a part of the emitting surface exhibits an electron affinity of less than zero volts.

5. An electrically modulatable electron emitter comprising:

a diamond semiconductor electron emitter having a bulk of diamond semiconductor material with an emitting surface for emitting electrons and a major surface;

a layer of conductive/semiconductive material at least partially disposed on the major surface of the diamond semiconductor electron emitter such that a junction having a depletion region, and a depletion region width associated therewith, is formed at the interface corresponding thereto; and a voltage source operably coupled to the layer of conductive/semiconductive material, such that modulation of the voltage source causes modulation of the junction depletion region width and effectively controls electrons transiting the bulk of the diamond semiconductor material to the emitting surface.

6. The electron emitter of claim 5 wherein the diamond semiconductor electron emitter is disposed on a supporting substrate.

7. The electron emitter of claim 5 wherein at least a part of the emitting surface exhibits an electron affinity of less than 1 electron volt.

8. The electron emitter of claim 5 wherein at least a part of the emitting surface exhibits an electron affinity of less than zero volts.

9. A field emission device comprising:

a supporting substrate having a major surface;

a selectively shaped diamond semiconductor electron emitter having a major surface and an emitting surface, the diamond semiconductor electron emitter being disposed on the major surface of the supporting substrate;

a layer of insulator material disposed on the major surface of the supporting substrate and on a part of the major surface of the diamond semiconductor electron emitter; and a layer of conductive/semiconductive material disposed on the layer of insulator material and in physical contact with a part of the major surface of the diamond semiconductor electron emitter, such that a junction having a depletion region, and a depletion region width associated therewith, is formed at the interface corresponding thereto.

10. The field emission device of claim 9 and further comprising a plurality of selectively shaped diamond semiconductor electron emitters.

11. The field emission device of claim 9 wherein the layer of conductive/semiconductive material is selectively formed as a plurality of electrically independent stripes.

12. The field emission device of claim 9 wherein at least a part of the emitting surface of the electron emitter exhibits an electron affinity of less than 1 electron volt.

13. The field emission device of claim 9 wherein at least a part of the emitting surface of the electron emitter exhibits an electron affinity of less than zero volts.

14. A field emission device comprising:

a supporting substrate having a major surface;

a first layer of selectively patterned conductive/semiconductive material disposed on the major surface of the supporting substrate;

a selectively shaped diamond semiconductor electron emitter having a major surface and an emitting surface, the diamond semiconductor electron emitter being disposed on the first layer of selectively patterned conductive/semiconductive material;

a layer of insulator material disposed on the major surface of the supporting substrate and at least a part of the major surface of the diamond semiconductor electron emitter; and a second layer of conductive/semiconductive material disposed on the layer of insulator material and in physical contact with the major surface of the diamond semiconductor electron emitter, such that a junction having a depletion region and having a depletion region width associated therewith is formed at the interface between the layer of conductive/semiconductive material and the diamond semiconductor electron emitter major surface.

15. The field emission device of claim 14 wherein the first layer of conductive/semiconductive material is selectively formed as a plurality of electrically independent stripes.

16. The field emission device of claim 14 wherein the second layer of conductive/semiconductive material is selectively formed as a plurality of electrically independent stripes.

17. The field emission device of claim 14 wherein at least a part of the emitting surface of the diamond semiconductor electron emitter exhibits an electron affinity of less than 1 electron volt.

18. The field emission device of claim 14 wherein at least a part of the emitting surface of the diamond semiconductor electron emitter exhibits an electron affinity of less than zero volts.

19. A field emission device comprising:

a supporting substrate having a major surface;

a first layer of selectively patterned conductive/semiconductive material disposed on the major surface of the supporting substrate;

a first selectively shaped diamond semiconductor electron emitter having a major surface and an emitting surface, the diamond shaped semiconductor electron emitter being disposed on the first layer of selectively patterned conductive/semiconductive material;

a layer of insulator material disposed on the major surface of the supporting substrate and a part of the major surface of the diamond semiconductor electron emitter;

a second layer of conductive/semiconductive material disposed on the layer of insulator material and in physical contact with the major surface of the diamond semiconductor electron emitter such that a junction having a depletion region, and a depletion region width associated therewith, is formed at the interface corresponding thereto; and an anode distally disposed with respect to the emitting surface of the diamond semiconductor electron emitter for collecting emitted electrons.

20. The field emission device of claim 19 wherein the first layer of conductive/semiconductive material is selectively formed as a plurality of electrically independent stripes.

21. The field emission device of claim 19 wherein the second layer of conductive/semiconductive material is selectively formed as a plurality of electrically independent stripes.

22. The field emission device of claim 19 wherein at least a part of the emitting surface of the diamond semiconductor electron emitter exhibits an electron affinity of less than 1 electron volt.

23. The field emission device of claim 19 wherein at least a part of the emitting surface of the diamond semiconductor electron emitter exhibits an electron affinity of less than zero volts.

24. The field emission device of claim 19 wherein the anode electrode includes a substantially optically transparent faceplate having a surface, a layer of cathodoluminescent material disposed on the surface of the faceplate, and a conductive layer disposed on the layer of cathodoluminescent material.

25. The field emission device of claim 19 wherein the anode electrode includes a substantially optically transparent faceplate having a surface, a conductive layer disposed on the surface of the faceplate, and a layer of cathodoluminescent material disposed on the conductive layer.

26. A field emission device comprising:

a supporting substrate having a major surface;

a first selectively shaped diamond semiconductor electron emitter having a major surface and an emitting surface, the diamond semiconductor electron emitter being disposed on the major surface of the supporting substrate;

a layer of insulator material disposed on the major surface of the supporting substrate and a part of the major surface of the diamond semiconductor electron emitter;

a layer of conductive/semiconductive material disposed on the layer of insulator material and in physical contact with the major surface of the diamond semiconductor electron emitter such that a junction having a depletion region, and having an associated depletion region width, is formed at the interface between the layer of conductive/semiconductive material and the diamond semiconductor electron emitter major surface; and an anode distally disposed with respect to the emitting surface of the diamond semiconductor electron emitter for collecting emitted electrons.

27. The field emission device of claim 26 wherein the anode electrode includes a substantially optically transparent faceplate having a surface, a layer of cathodoluminescent material disposed on the surface of the faceplate, and a conductive layer disposed on the layer of cathodoluminescent material.

28. The field emission device of claim 26 wherein at least a part of the emitting surface of the diamond semiconductor electron emitter exhibits an electron affinity of less than 1 electron volt.

29. The electron emitter of claim 26 wherein at least a part of the emitting surface of the diamond semiconductor electron emitter exhibits an electron affinity of less than zero volts.

30. A field emission device comprising:

a supporting substrate having a major surface; electron emitter having a bulk with a major surface and an emitting surface, the diamond semiconductor electron emitter being disposed on a part of the major surface of the supporting substrate;

a layer of insulator material disposed on the major surface of the supporting substrate and a part of the major surface of the diamond semiconductor electron emitter;

a layer of conductive/semiconductive material disposed on the layer of insulator material and in physical contact with the major surface of the diamond semiconductor electron emitter such that a junction having a depletion region, and having a depletion region width associated therewith, is formed at the interface between the layer of conductive/semiconductive material and the diamond semiconductor electron emitter major surface and extending into the bulk of the diamond semiconductor electron emitter; and a first externally provided voltage source operably coupled to the layer of conductive/semiconductive material and modulating the width of the junction depletion region, such that modulation of the junction width effectively controls the availability of electrons at the emitting surface of the diamond semiconductor electron emitter.

31. The field emission device of claim 30 wherein at least a part of the emitting surface of the diamond semiconductor electron emitter exhibits an electron affinity of less than 1 electron volt.

32. The field emission device of claim 30 wherein at least a part of the emitting surface of the diamond semiconductor electron emitter exhibits an electron affinity of less than zero volts.

33. A field emission device comprising:

a supporting substrate having a major surface;

a first selectively shaped diamond semiconductor electron emitter having a bulk with a major surface and an emitting surface, the diamond semiconductor electron emitter being disposed on a part of the major surface of the supporting substrate;

a layer of insulator material disposed on the major surface of the supporting substrate and a part of the major surface of the diamond semiconductor electron emitter;

a layer of conductive/semiconductive material disposed on the layer of insulator material and in physical contact with the major surface of the diamond semiconductor electron emitter such that a junction having a depletion region, and having a depletion region width associated therewith, is formed at the interface between the layer of conductive/semiconductive material and the diamond semiconductor electron emitter major surface and extending into the bulk of the diamond semiconductor electron emitter;

a voltage source operably coupled to the layer of conductive/semiconductive material for modulating the width of the junction depletion region; and an anode for collecting electrons emitted from the diamond semiconductor electron emitter emitting surface, such that modulation of the junction width effectively controls the availability of electrons at the emitting surface of the diamond semiconductor electron emitter.

34. The field emission device of claim 33 wherein the anode electrode includes a substantially optically transparent faceplate having a surface, and a layer of cathodoluminescent material disposed on the surface of the faceplate, and a conductive layer disposed on the layer of cathodoluminescent material.

35. The field emission device of claim 33 wherein the anode electrode includes a substantially optically transparent faceplate having a surface, a conductive layer disposed on the surface of the faceplate, and a layer of cathodoluminescent material disposed on the conductive layer.

36. The field emission device of claim 33 wherein at least a part of the emitting surface of the diamond semiconductor electron emitter exhibits an electron affinity of less than 1 electron volt.

37. The field emission device of claim 33 wherein at least a part of the emitting surface of the diamond semiconductor electron emitter exhibits an electron affinity of less than zero volts.

38. A field emission device comprising:

a supporting substrate having a major surface;

a first layer of selectively patterned conductive/semiconductive material disposed on the major surface of the supporting substrate;

a selectively shaped diamond semiconductor electron emitter having a major surface and an emitting surface, the diamond semiconductor electron emitter being disposed on the first layer of selectively patterned conductive/semiconductive material;

a layer of insulator material disposed on the major surface of the supporting substrate and a part of the major surface of the diamond semiconductor electron emitter;

a second layer of conductive/semiconductive material disposed on the layer of insulator material and in physical contact with the major surface of the diamond semiconductor electron emitter such that a junction having a depletion region, and a depletion region width associated therewith, is formed at the interface corresponding thereto;

a voltage source operably coupled to the second layer of conductive/semiconductive material for modulating the width of the junction depletion region; and an anode for collecting electrons emitted from the emitting surface of the diamond semiconductor electron emitter, such that modulation of the junction width effectively controls the availability of electrons at the emitting surface of the diamond semiconductor electron emitter.

39. The field emission device of claim 38 wherein the first layer of conductive/semiconductive material is selectively formed as a plurality of electrically independent stripes.

40. The field emission device of claim 38 wherein the second layer of conductive/semiconductive material is selectively formed as a plurality of electrically independent stripes.

41. The field emission device of claim 38 wherein the anode electrode includes a substantially optically transparent faceplate having a surface, a layer of cathodoluminescent material disposed on the surface of the faceplate, and a conductive layer disposed on the layer of cathodoluminescent material.

42. The field emission device of claim 38 wherein the anode electrode includes a substantially optically transparent faceplate having a surface, a conductive layer disposed on the surface of the faceplate, and a layer of cathodoluminescent material disposed on the conductive layer.

43. The field emission device of claim 38 wherein at least a part of the emitting surface of the diamond semiconductor electron emitter exhibits an electron affinity of less than 1 electron volt.

44. The field emission device of claim 38 wherein at least a part of the emitting surface of the diamond semiconductor electron emitter exhibits an electron affinity of less than zero volts.

45. A method of producing an electrically modulatable electron emitter comprising the steps of:

forming a diamond semiconductor electron emitter with an emitting surface for emitting electrons and a major surface; and forming a layer of conductive/semiconductive material in contact with the major surface of the diamond semiconductor electron emitter such that an electron depletion region, and a depletion region width associated therewith, is formed at an interface between the diamond semiconductor electron emitter and the layer of conductive/semiconductive material.

46. A method of producing an electrically modulatable electron emitter as set forth in claim 45 including in addition the step of coupling a voltage source to the layer of conductive/semiconductive material, such that modulation of the voltage source causes modulation of the depletion region width and effectively controls electrons transiting the bulk of the diamond semiconductor material to the emitting surface.

47. A method of producing a field emission device comprising the steps of:

forming a selectively shaped diamond semiconductor electron emitter with a major surface and an emitting surface;

forming a layer of conductive/semiconductive material in physical contact with the major surface of the diamond semiconductor electron emitter such that a junction having a depletion region, and a depletion region width associated therewith, is formed at an interface between the diamond semiconductor electron emitter and the layer of conductive/semiconductive material; and forming an anode distally disposed with respect to the emitting surface of the diamond semiconductor electron emitter for collecting emitted electrons from the emitting surface of the diamond semiconductor electron emitter, such that modulation of the junction width effectively controls the availability of electrons at the emitting surface of the diamond semiconductor electron emitter.

48. A method of producing a field emission device as claimed in claim 47 including in addition the step of coupling a voltage source to the layer of conductive/semiconductive material for modulating the width of the junction depletion region.

49. A method of producing a field emission device as claimed in claim 47 wherein the step of forming the anode includes forming a substantially optically transparent faceplate having a surface, disposing a layer of cathodoluminescent material on the surface of the faceplate, and disposing a conductive layer on the layer of cathodoluminescent material.

50. A method of producing a field emission device as claimed in claim 47 wherein the step of forming the anode includes forming a substantially optically transparent faceplate having a surface, disposing a conductive layer on the surface of the faceplate, and disposing a layer of cathodoluminescent material on the conductive layer.

* * * * *